US012685426B2

(12) United States Patent
Li

(10) Patent No.: US 12,685,426 B2
(45) Date of Patent: Jul. 21, 2026

(54) ELECTRIC DUSTERS

(71) Applicant: James Li, Milpitas, CA (US)

(72) Inventor: James Li, Milpitas, CA (US)

(73) Assignee: James Li, Milpitas, CA (US)

( * ) Notice: Subject to any disclaimer, the term of this patent is extended or adjusted under 35 U.S.C. 154(b) by 562 days.

(21) Appl. No.: 18/173,055

(22) Filed: Feb. 22, 2023

(65) Prior Publication Data

US 2024/0277206 A1 Aug. 22, 2024

(51) Int. Cl.

| | |
|---|---|
| ***A47L 13/38*** | (2006.01) |
| ***A46B 5/00*** | (2006.01) |
| ***A46B 5/02*** | (2006.01) |
| ***A46B 7/04*** | (2006.01) |
| ***A46B 9/02*** | (2006.01) |
| ***A46B 13/00*** | (2006.01) |
| ***A46B 13/02*** | (2006.01) |
| ***A46B 15/00*** | (2006.01) |
| ***A47L 13/42*** | (2006.01) |

(52) U.S. Cl.

CPC ..... *A47L 13/38* (2013.01); *A46B 5/005* (2013.01); *A46B 5/02* (2013.01); *A46B 7/04* (2013.01); *A46B 9/026* (2013.01); *A46B 13/001* (2013.01); *A46B 13/02* (2013.01); *A46B 15/0004* (2013.01); *A47L 13/42* (2013.01); *A46B 2200/3026* (2013.01)

(58) Field of Classification Search

CPC ..... A47L 13/38; A46B 5/005; A46B 7/04; A46B 13/001

See application file for complete search history.

(56) References Cited

U.S. PATENT DOCUMENTS

| | | | | |
|---|---|---|---|---|
| 3,106,732 | A * | 10/1963 | Dayton | A61C 13/12 15/28 |
| 5,692,417 | A * | 12/1997 | Irpino | B25B 13/48 81/53.12 |
| 10,624,447 | B1 * | 4/2020 | Manning | A46B 13/001 |
| 11,154,173 | B1 * | 10/2021 | Ramsey | A47L 11/4075 |
| 2006/0228161 | A1 * | 10/2006 | Hoadley | A46B 5/0075 401/136 |

FOREIGN PATENT DOCUMENTS

| | | |
|---|---|---|
| AU | 5326/12 | 6/1912 |

* cited by examiner

*Primary Examiner* — Shay Karls
(74) *Attorney, Agent, or Firm* — Melvin Li

(57) ABSTRACT

The present invention is concerned with an electric duster. The electric duster has an elongate profile defining a longitudinal axis. The electric duster has a utility portion arranged at a distal end of the electric duster, a grip portion arranged at a proximal end of the electric duster and a connecting portion arranged between the utility portion and the grip portion. The utility portion is rotatable about the longitudinal axis and the electric duster is further provided with a chamber containing a drive mechanism for providing rotational drive to the utility portion.

11 Claims, 16 Drawing Sheets

ELECTRIC DUSTERS

FIELD OF THE INVENTION

The present invention is concerned with a cleaning implement, and in particular an electric duster adapted to reach difficult to reach areas of a premises.

BACKGROUND OF THE INVENTION

The following discussion of the background art is intended to facilitate an understanding of the present invention only. It should be appreciated that the discussion is not an acknowledgement or admission that any of the material referred to was part of the common general knowledge as at the priority date of the application.

There are a variety of cleaning implements in the market to assist a user to perform cleaning tasks. One example is the manual floor mop. While floor mops are suitable in certain cleaning tasks, the mopping head is often designed to mop a floor surface and not for cleaning other surface or areas in a premises. Another example is the vacuum cleaner. While vacuum cleaners are useful in that they are more powerful to remove dust and crumbs, they are usually relatively bulky. To address this, vacuum cleaner engineers have designed more compact accessories for accessing difficult to reach areas. However, still they are cleaning by way of suctioning, and they typically are not designed to be used with a cleaning detergent.

The present invention seeks to address at least the aforementioned problems, or at least to provide alternatives to the public.

SUMMARY OF THE INVENTION

According to a first aspect of the present invention, there is provided an electric duster with an elongate profile defining a longitudinal axis, comprising a utility portion arranged at a distal end of the electric duster, a grip portion arranged at a proximal end of the electric duster, and a connecting portion arranged between and connecting the utility portion and the grip portion, wherein the utility portion is rotatable about the longitudinal axis and the electric duster is provided with a chamber containing a drive mechanism for providing rotational drive to the utility portion.

Preferably, the utility portion may include a core member and brushing filaments enveloping the core member whereby in use rotation of the core member causes corresponding rotation of the brushing filaments.

Suitably, the drive mechanism may be provided with a motor, a gear box and an axle head extending from the gear box for driving the utility portion. The motor drives the gear box which in turn drives the axle head and then the utility portion.

Advantageously, the brushing filaments may assume the form of a sock enveloping the core member and may be removably securable to the core member.

The utility portion may be rotatable, reciprocatingly, about the longitudinal axis.

The connecting portion may include one or more circular tubes telescopically extendible along the longitudinal axis.

In a first embodiment, the chamber may be positioned behind the utility portion and is arranged between the utility portion and the connecting portion such that the utility portion is drivenable directly by the axle head. The electric duster may comprise a battery compartment positioned adjacent and behind the chamber, and within the distal end of the connecting portion. The electric duster may comprise a switch for controlling operation of the drive mechanism and protruded from the chamber. One advantage of this configuration is that driving power from the motor is more efficiently and effectively transferred to the utility portion.

In a second embodiment, the connecting portion may include at least a first circular tube, a second circular tube and the chamber, the first circular tube may be positioned between the utility portion and the chamber, and the second circular tube may be positioned between the chamber and the grip portion. The electric duster may comprise a battery compartment positioned adjacent and behind the chamber, and within the distal end of the second circular tube. The electric duster may comprise a switch for controlling operation of the drive mechanism and protruded from the chamber. The electric duster may comprise an axle connecting the axle head and the utility portion and housed in the first circular tube and being sufficiently long to reach and provide rotational drive to the utility portion. One advantage of this configuration is that with the weight of the chamber arranged at a mid-portion of the electric duster, a user holding the electric duster at the grip portion can more easily maneuver the electric duster as compared to when the chamber is located at the distal end of the connecting portion or between the utility portion and the connecting portion.

In a third embodiment, the chamber and the battery compartment may be housed within the grip portion. The electric duster may comprise a switch for controlling operation of the drive mechanism and protruded from the grip portion. The electric duster may comprise an axle connecting the axle head and the utility portion and housed in the connecting portion and may be sufficiently long to reach and provide rotational drive to the utility portion. One advantage of this configuration is that with both the chamber and the switch located at the grip portion, more weight resides at the proximal end of the electric duster allowing a user to maneuver the electric duster more easily and to control the operation of the electric duster at the grip portion.

In a fourth embodiment, the chamber may be adjacent and positioned behind the utility portion and may be arranged between the utility portion and the connecting portion. The electric duster may comprise a compartment for batteries housed in the grip portion providing power to the motor. The electric duster may comprise a switch at the grip portion for controlling operation of the drive mechanism. The electric duster may comprise electric wires connecting and extending from the switch, the batteries and the drive mechanism within and along the connecting portion. With the configuration of the positioning of the chamber at the distal end and the switch at the grip portion, one advantage is that, the driving of the utility portion by the motor is more efficient and effective and yet the control, e.g. on/off, of the electric duster is within the reach of the fingers of the user.

The afore-described embodiments all share the feature of the core member to which the cleaning filament sock is fitted, and the core member may assume the configuration of a cylindrical block to which either the axle head or a connecting axle engages. However, in an alternative embodiment, the core member may be configured differently in that the block is somewhat flattened such that a transverse cross section of the block may assume an oval shape. One advantage of this flattened or oval structure is that, the utility portion can reach even smaller gaps, e.g. between a refrigerator and an adjacent wall. Regardless of the exact profile of the core member, the utility portion, preferably, may have a width or diameter from 1 cm to 4 cm. In a more preferred embodiment, the width or diameter is from 1 cm to 2 cm. The length of the core member may preferably be at least 12 cm, and up to 60 cm.

BRIEF DESCRIPTION TO THE DRAWINGS

Some embodiments of the present invention will now be explained, with reference to the accompanied drawings, in which.

DETAILED DESCRIPTION OF PREFERRED EMBODIMENTS OF THE INVENTION

Figure 1:
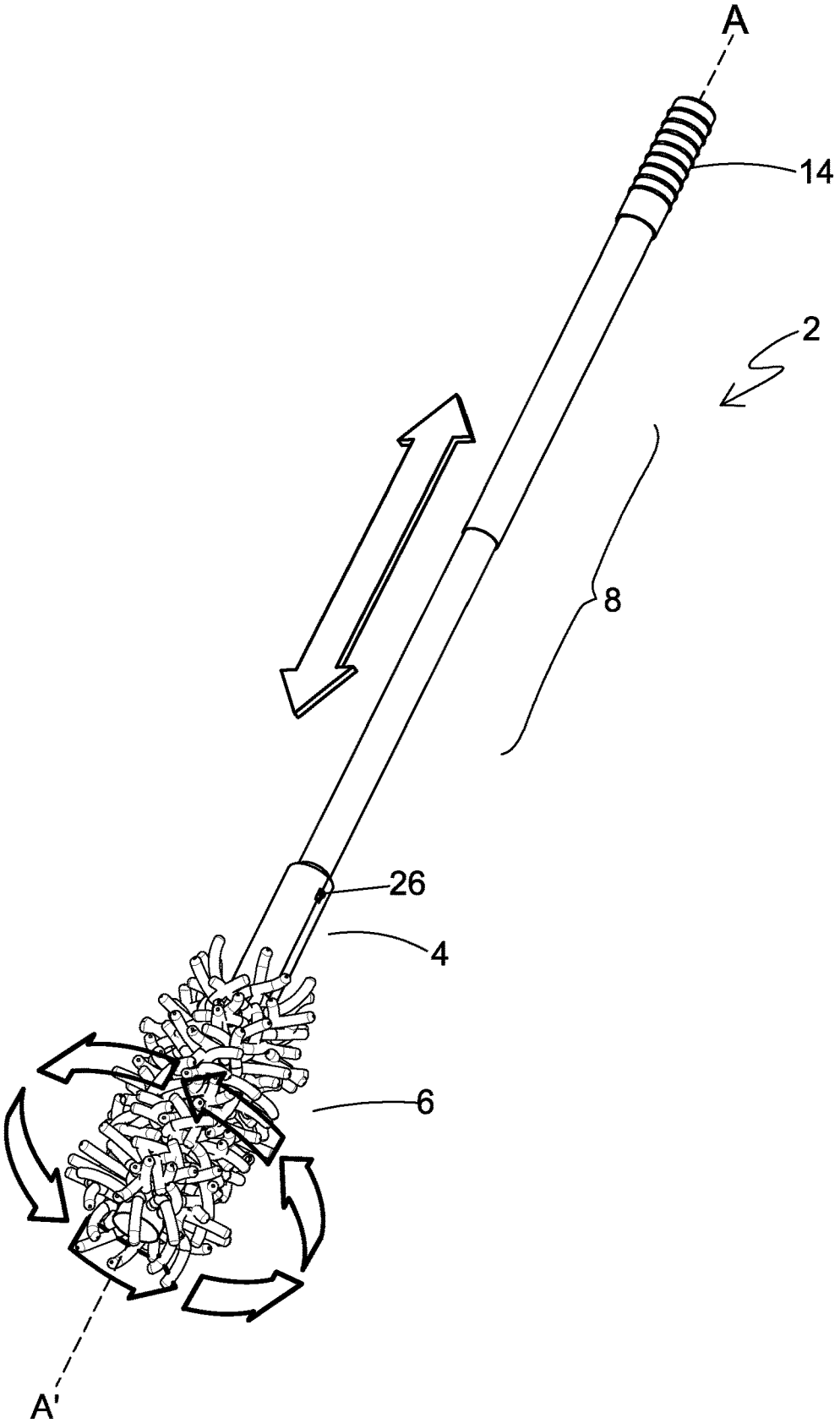
FIG. 1 is a schematic diagram illustrating a first embodiment of an electric duster according to the present invention.

FIGS. 1 to 16 illustrate embodiments of a cleaning implement or an electric duster of the present invention.

Generally, an electric duster according to the present invention assumes an elongate profile defining a longitudinal axis extending along the length of the electric duster. The electric duster comprises a utility portion arranged at a distal end of the electric duster, a grip portion arranged at a proximal end of the electric duster and a connecting portion arranged between the utility portion and the grip portion. The utility portion is rotatable uni-directionally or reciprocatingly about the longitudinal axis during operation. The electric duster is provided with a chamber containing a drive mechanism for providing rotational drive to the utility portion. The grip portion is provided with ridges allowing a user to hold on to it securely during use. The utility portion includes a core member and brushing filaments enveloping the core member whereby in use rotation of the core member causes corresponding rotation of the brushing filaments.

The drive mechanism is provided with a motor, a gear box and an axle head extending from the gear box for driving the utility portion. The brushing filaments assume the form of a sock enveloping the core member and are removably securable to the core member. The brushing filament sock is replaceable for washing. The electric duster may be provided with multiple brushing filament socks with filaments of different coarseness to suit different cleaning needs in a cleaning exercise. A user can simply choose an appropriate cleaning media. The brushing filament socks are adapted to be used in conjunction with a suitable cleaning detergent. He core member is provided with a recess at its proximal end to which either an axle head or a connecting axle from the drive mechanism engages.

The utility portion may be rotatable, reciprocatingly, about the longitudinal axis. The connecting portion may include one or more circular tubes telescopically extendible along the longitudinal axis. The utility portion may be rotatable in one of a number of pre-designed speeds.

FIGS. 1 to 4 illustrate a first specific embodiment of an electric duster 2. The electric duster 2 is provided with a chamber 4 positioned behind a utility portion 6 and is arranged between the utility portion 6 and a connecting portion 8 such that the utility portion 6 is directly drivenable by an axle head 10. In this embodiment, the electric duster is free of a connecting axle between the axle head 10 and the utility portion 6. The use of a direct driving mechanism without using an intermediate connecting axle allows the actuation of the utility portion in a more responsive manner. FIG. 2A specifically shows that, along the length of the electric duster, there is provided a grip portion 14, the connecting portion 8, a battery compartment 16 positioned in the distal end of the connecting portion 8, the drive mechanism housing a motor 18 powered by batteries 20 in the battery compartment 16 from behind and providing mechanical rotational drive to the axle head 10 which in turn provide rotational drive to the utility portion 6. The chamber 4 has a slightly enlarged width/diameter compared to the connection portion 8.

Figures 2A, 2B, 2C:
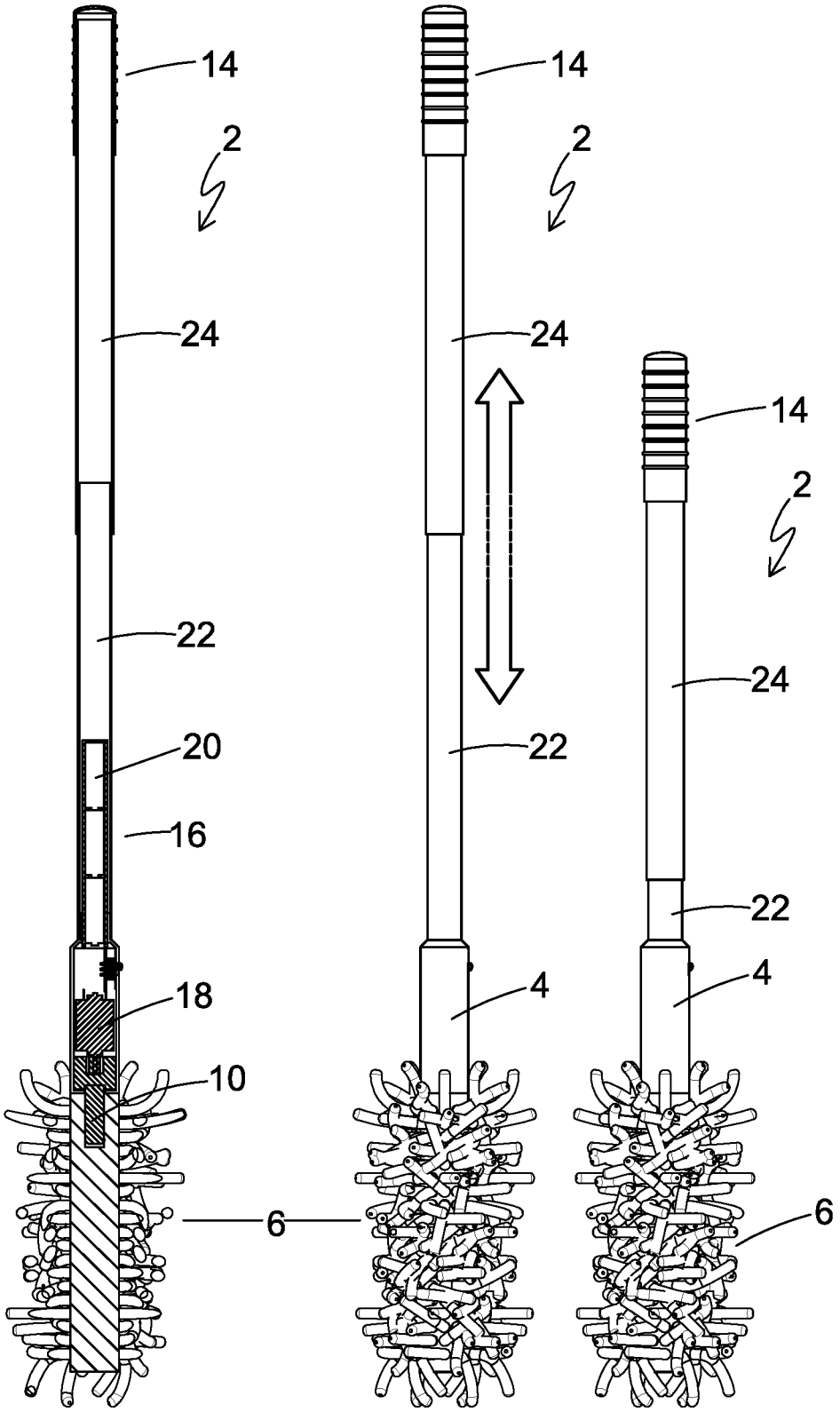
FIG. 2A is a schematic view of the electric duster of FIG. 1 showing internal structures thereof.
FIG. 2B is a side view of the electric duster of FIG. 1 in an extended configuration.
FIG. 2C is a side view of the electric duster of FIG. 1 but in a retracted configuration.

FIG. 2B and FIG. 2C show that the connecting portion 8 includes two circular tube sections, namely a front circular tube section 22 and a rear circular tube section 24. The connecting portion 8 is telescopically extendible in which the front circular tube section 22 is retractable within the rear circular tube section 24. When extended, the electric duster 2 can reach a farther away location. When retracted, the electric duster 2 becomes more compact and suitable, for example, for storage.

Figures 3A, 3B, 3C:
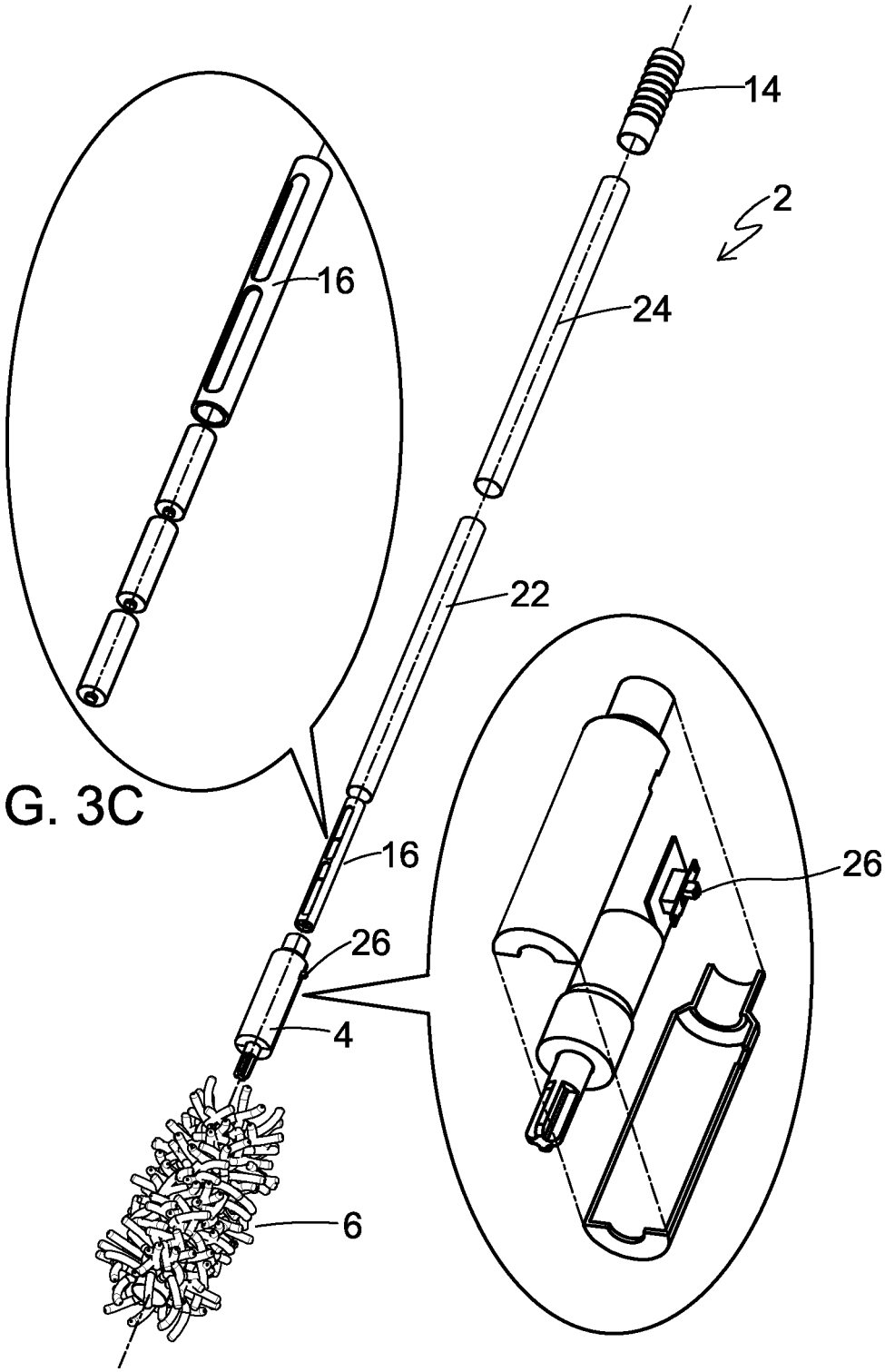
FIG. 3A is an exploded view of the electric duster of FIG. 1.
FIG. 3B is a schematic view showing a drive mechanism of the electric duster of FIG. 3A.
FIG. 3C is a schematic view showing a battery compartment of the electric duster of FIG. 3A.

FIG. 3A is an exploded view of the electric duster 2 and illustrates that the battery compartment 16 positioned at the distal end of the connecting portion 8. FIG. 3A also shows that the drive mechanism is positioned between the battery compartment 16 and the utility portion 6. FIG. 3B illustrates that the electric duster 2 provides a switch 26 for controlling operation of the drive mechanism and protruded from the chamber 4. In a further specific embodiment, the switch 26 allows different rotational mode, e.g. off, clockwise rotation, anti-clockwise rotation, reciprocating rotation.

Figure 4:
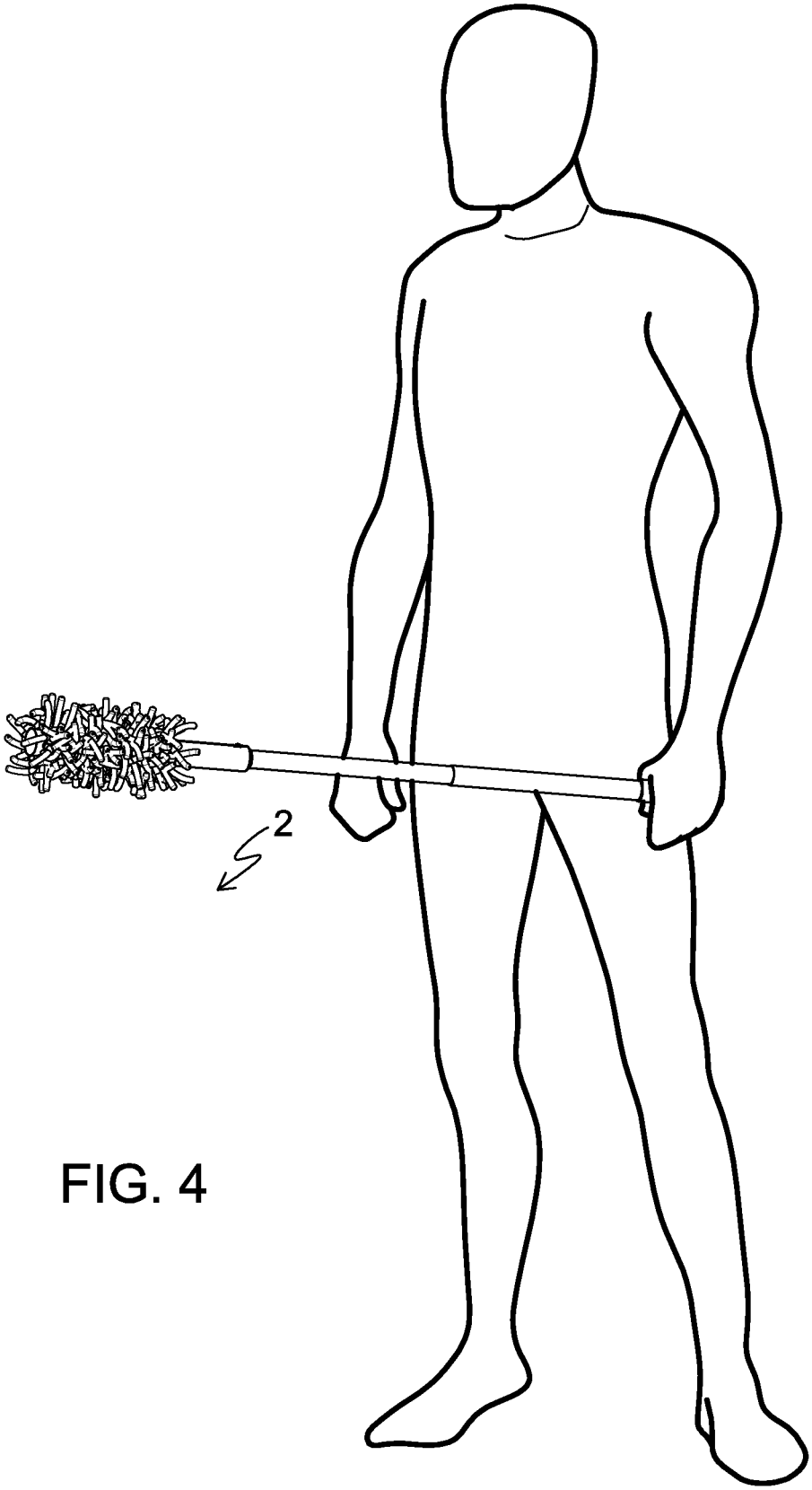
FIG. 4 is a schematic view showing a user holding on to the electric duster of FIG. 1.

FIG. 4 is a schematic view showing a user holding on to the electric duster 2 of FIG. 1.

Positioning of both the drive mechanism and the switch 2 at the distal end of the electric duster 2 is advantageous at least in a manufacturing perspective because all mechanical and electrical elements are located at the distal end of the electric duster 2; the need to connect such elements spaced apart across distant locations along the electric duster is not a concern.

FIGS. 5 to 8 illustrate a second embodiment of an electric duster 102. The electric duster likewise has a utility portion 106, a connecting portion 108 with two circular tube sections, namely a front circular tube section 122 and a rear circular tube section 124, a grip portion 114, a chamber 118 containing a drive mechanism and a battery compartment 116. However, the configuration of the connecting portion 108 is different. For example, the chamber 104 is positioned between the first circular tube section 122 and the second circular tube section 124, and the battery compartment 116 is positioned adjacent and behind the chamber 118 and within the distal end of the rear circular tube section 124. Please see FIG. 5 to FIG. 6B.

Figures 7A, 7B, 7C:
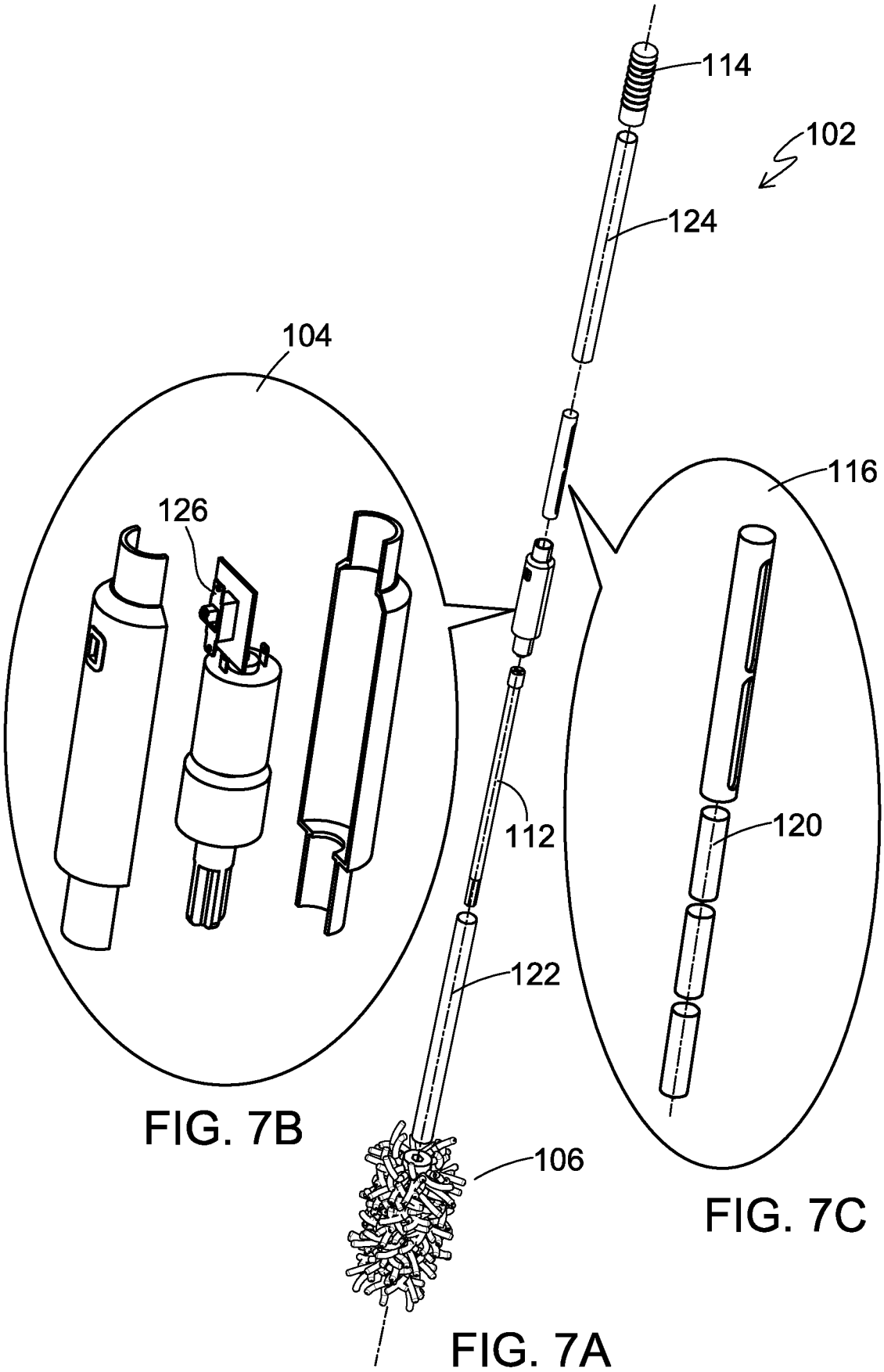
FIG. 7A is an exploded view of the electric duster of FIG. 5.
FIG. 7B is a schematic view showing a drive mechanism of the electric duster of FIG. 7A.
FIG. 7C is a schematic view showing a battery compartment of the electric duster of FIG. 3A.

FIG. 7A is an exploded view of the electric duster 102. FIGS. 7A to 7C show that the electric duster 102 is provided with a connecting axle 112 between an axle head 110 and the utility portion 106, the connecting axle 112 housed within the front circular tube section 122. A motor 118 of the drive mechanism provides rotational drive to the axle head 110 which in turn drive the connecting axle 112 and then utility portion 106. In this embodiment, the connecting portion 108 is not retractable.

FIG. 7B illustrates that the electric duster provides a switch 126 for controlling operation of the drive mechanism and protruded from the chamber 104. Likewise, the switch 126 allows different rotational mode, e.g. off, clockwise rotation, anti-clockwise rotation, reciprocating (or alternating) clockwise and anti-clockwise rotation.

Figure 5:
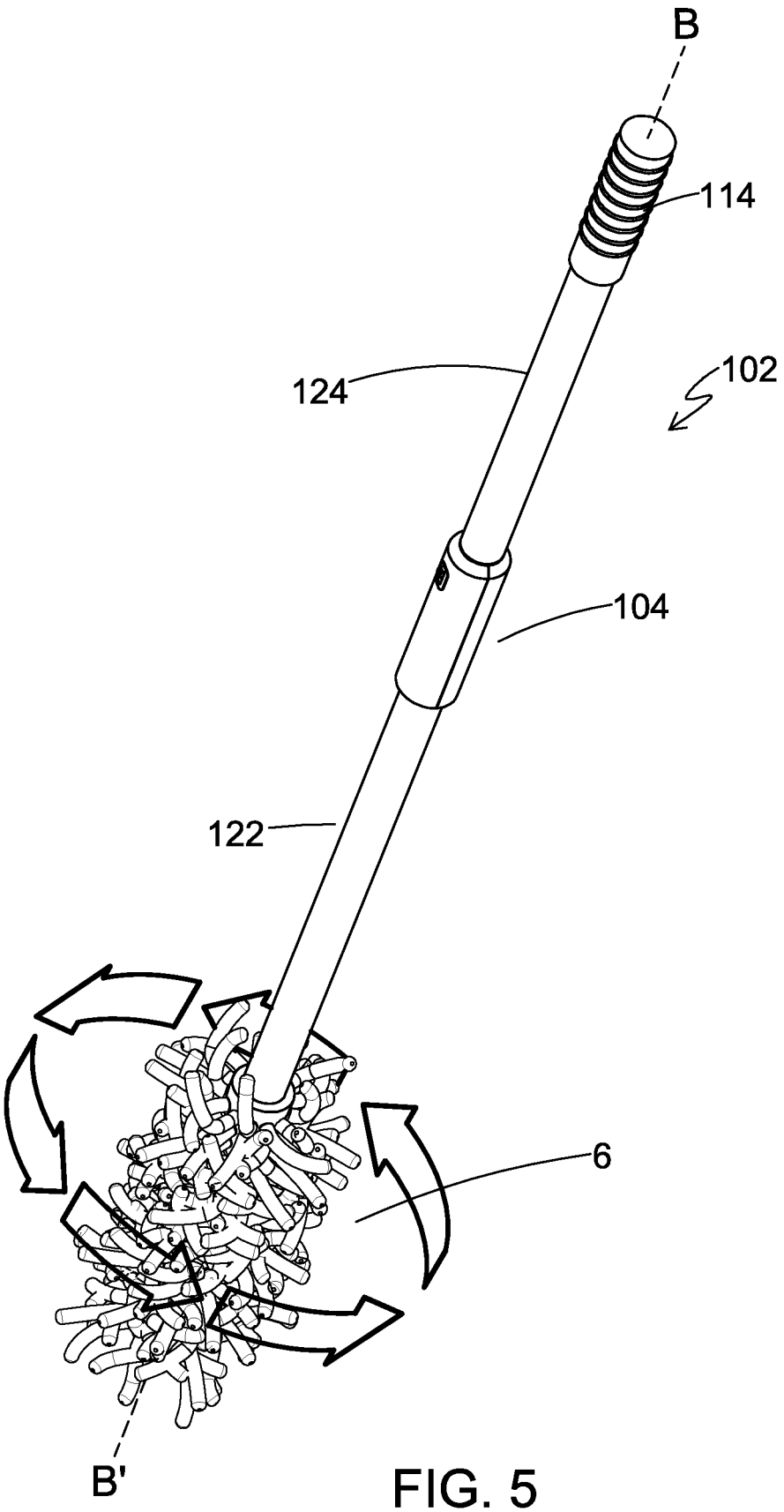
FIG. 5 is a schematic diagram illustrating a second embodiment of an electric duster according to the present invention.
Figure 6A:
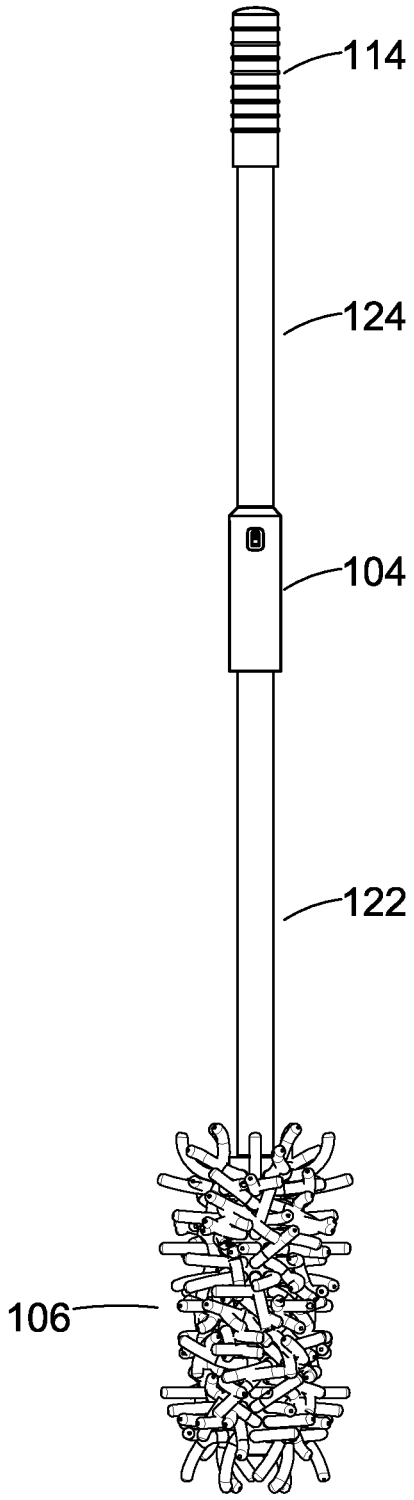
FIG. 6A is a side view of the electric duster of FIG. 5
Figure 6B:
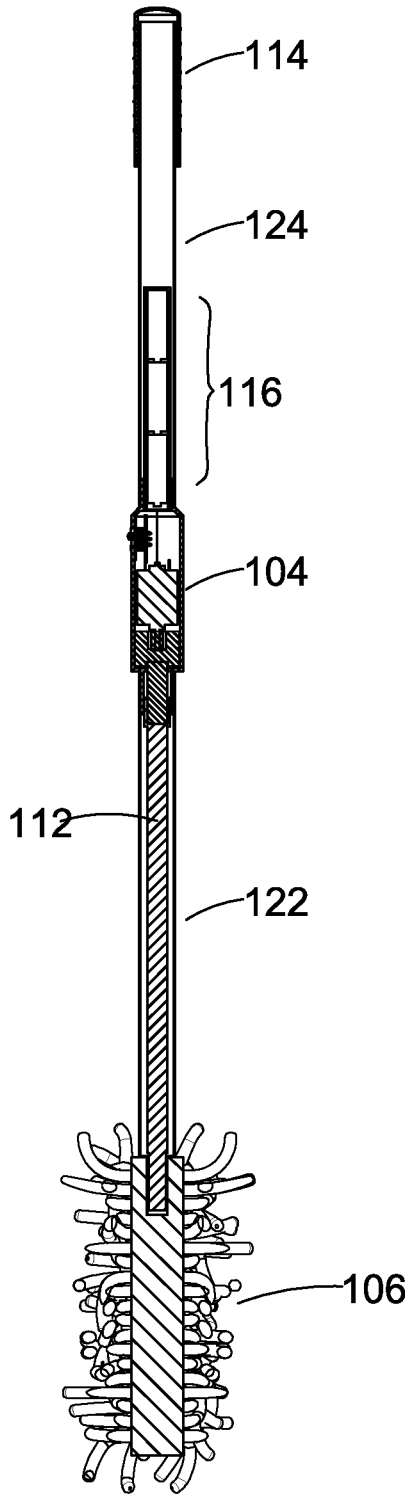
FIG. 6B is a schematic view showing internal structures thereof.
Figure 8:
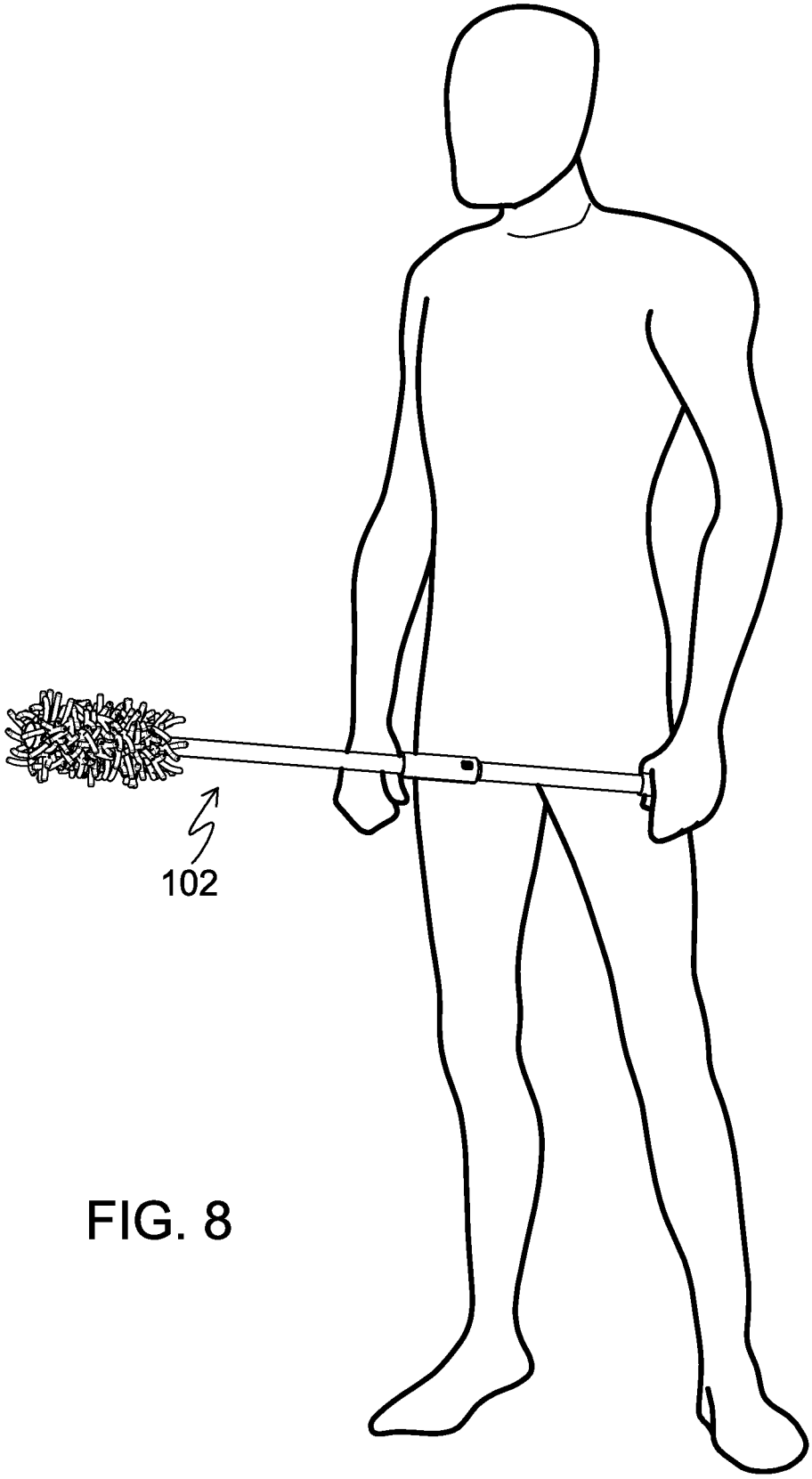
FIG. 8 is a schematic view showing a user holding on to the electric duster of FIG. 5.

FIG. 8 is a schematic view showing a user holding on to the electric duster 102 of FIG. 5.

Positioning of both the drive mechanism and the switch 126 at a mid-region of the electric duster 102 is beneficial in a multi-fold manner. One advantage is that in use the switch 126 is easier to reach by a user such that the user can access the switch 126 more conveniently. Further, when the chamber 104 with the drive mechanism is positioned further back, the entire distal end of the electric duster 102 (e.g. utility portion 106) can be kept with a slimmer profile so that in use the utility portion 106 can reach difficult to reach areas, e.g. tighter areas, without the (enlarged) chamber 104 getting in the way.

FIGS. 9 to 12 illustrate a third embodiment of an electric duster 202. The electric duster 202 also has a grip portion 214, a connecting portion 208, a utility portion 206, a chamber 204 containing a drive mechanism and a battery compartment 220. However, the connecting portion 208 has only one circular tube section 222 and is not retractable. In this embodiment, the chamber 204 is positioned within the distal end of the grip portion 214 while the battery compartment 220 is positioned behind and adjacent the chamber 204 within the grip portion 214. Similar to the second embodiment, the electric duster 202 is provided with a connecting axle 212 connecting an axle head 210 extended from a motor 218 of the drive mechanism to the utility portion 206. Please see FIGS. 9 to 12.

Figures 11A, 11B:
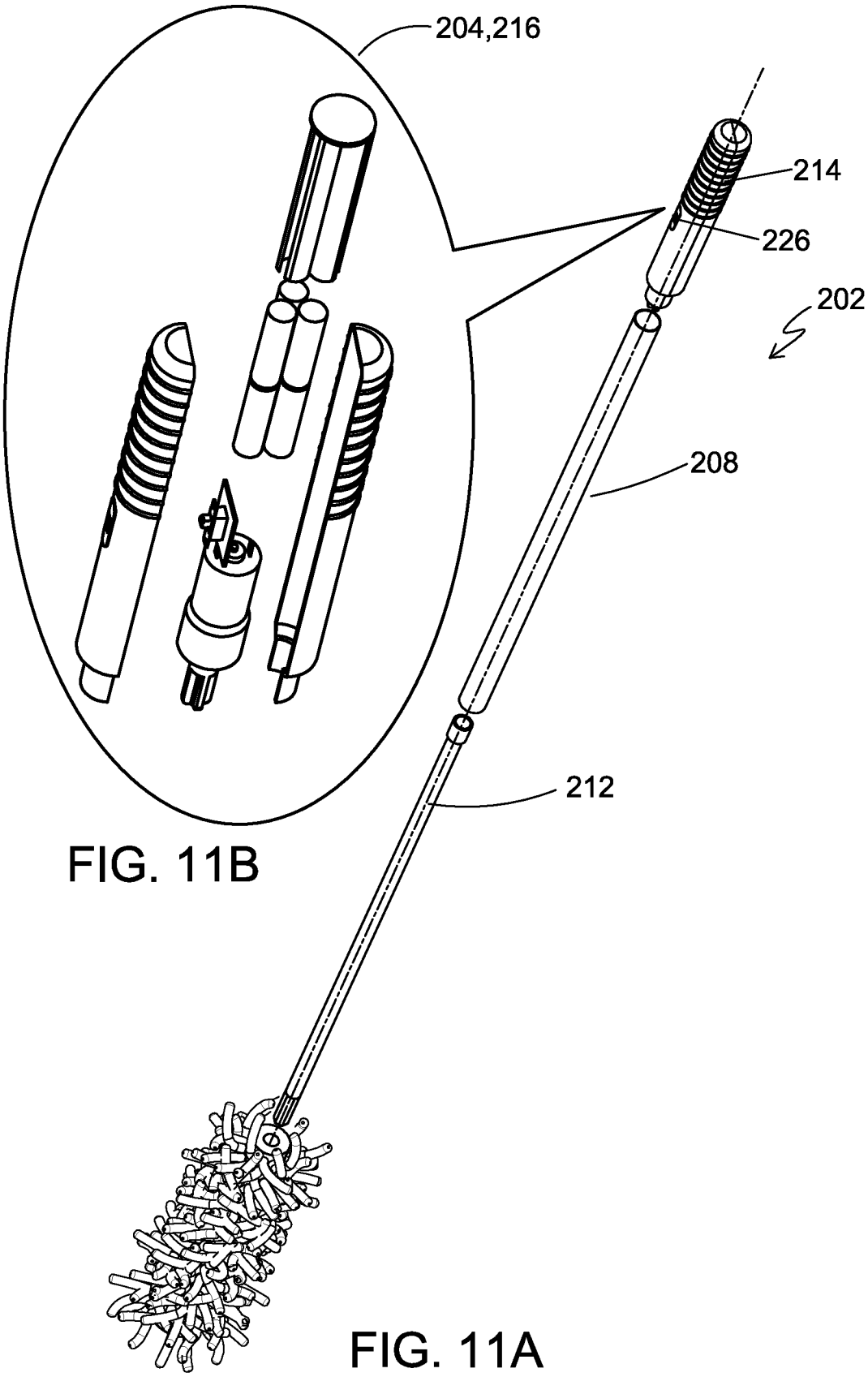
FIG. 11A is an exploded view of the electric duster of FIG. 9
FIG. 11B is a schematic view showing a drive mechanism of the electric duster of FIG. 11A.

FIGS. 11A and 11B illustrate that the electric duster 202 also provides a switch 226 for controlling operation of the drive mechanism and protruded from the chamber 204. Likewise, the switch 226 allows different rotational mode, e.g. off, clockwise rotation, anti-clockwise rotation, reciprocating rotation.

Figure 9:
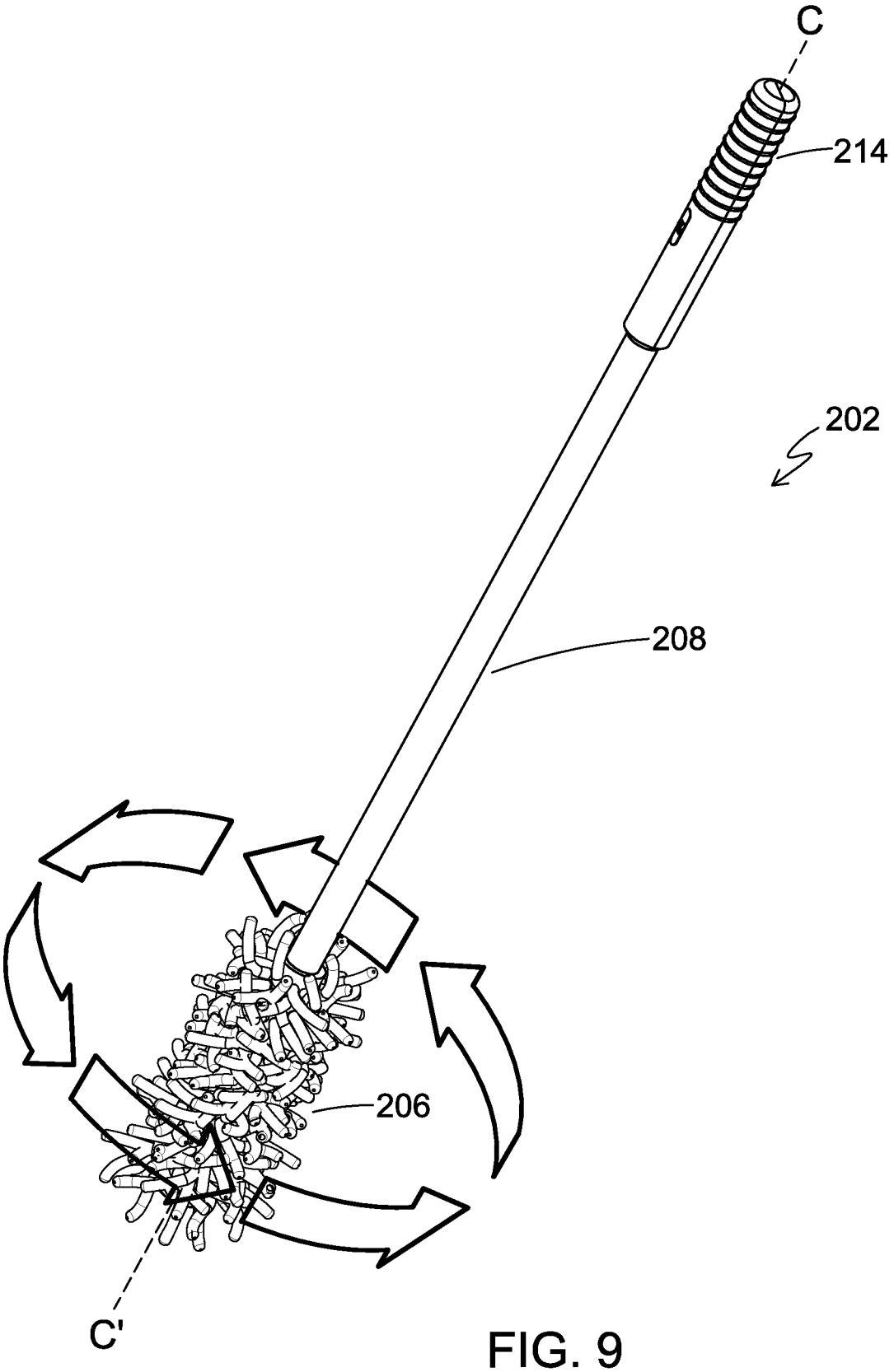
FIG. 9 is a schematic diagram illustrating a third embodiment of an electric duster according to the present invention.
Figure 10B:
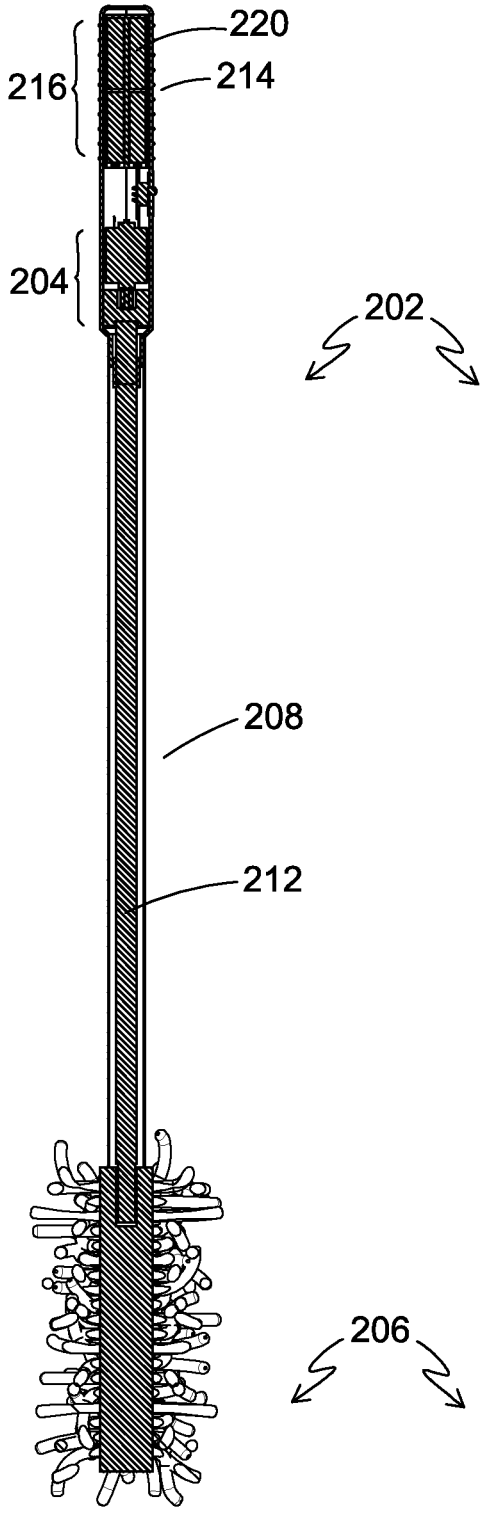
FIG. 10B is a schematic view showing internal structures thereof.
Figure 10A:
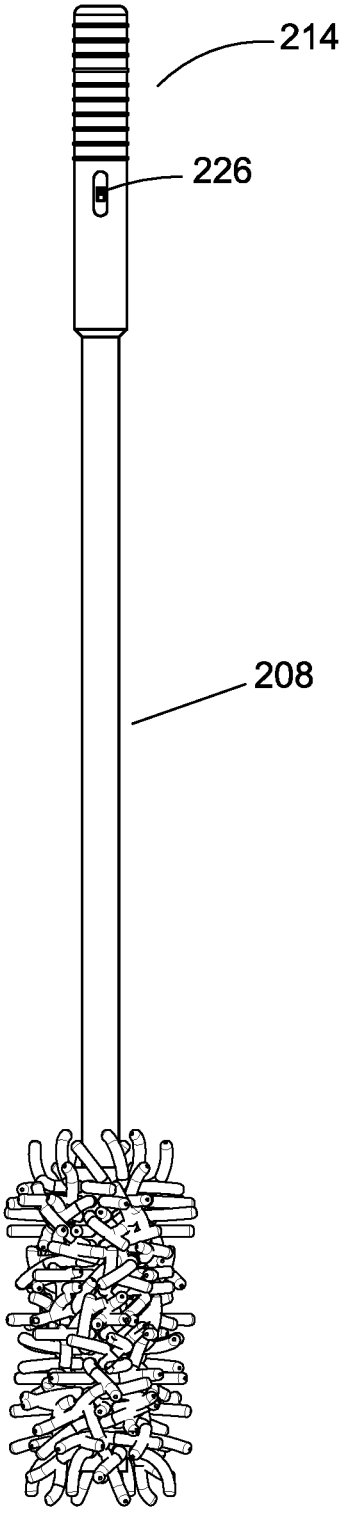
FIG. 10A is a side view of the electric duster of FIG. 9
Figure 12:
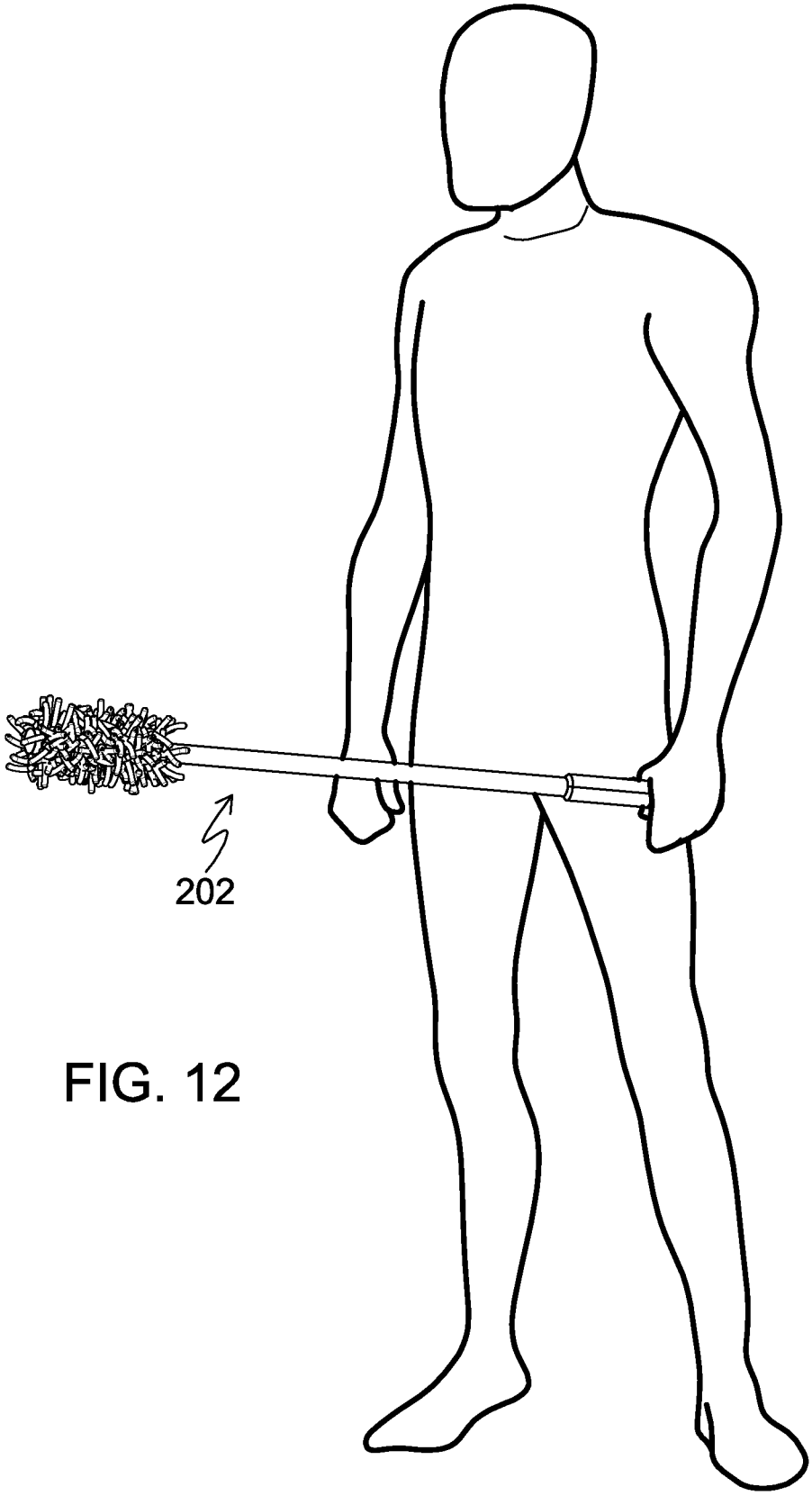
FIG. 12 is a schematic view showing a user holding on to the electric duster of FIG. 9.

FIG. 12 is a schematic view showing a user holding on to the electric duster 202 of FIG. 9.

Positioning of both the drive mechanism and the switch 226 at a proximal end of the electric duster 202 is beneficial in a multi-fold manner. One advantage is that the switch 226 located right at the grip portion 214 is reachable by a flick of a finger of the user. Further, when the chamber 204 with the drive mechanism is positioned further back, the entire distal end of the electric duster 202 (e.g. utility portion 206) can be kept with a slimmer profile so that in use the utility portion 206 can reach difficult to reach areas, e.g. tighter areas, without the (enlarged) chamber getting in the way.

FIGS. 13 to 16 illustrate a fourth embodiment of an electric duster 302. The electric duster 302 is also provided a grip portion 314, a connecting portion 308 and a utility portion 306. Similar to the third embodiment, the electric duster is provided with a chamber 304 housing a drive mechanism and located the distal end of the connecting portion 308. Please see FIGS. 14A and 14B. There are however differences. For example, the connecting portion 308 has only one circular tube section 322 and is not retractable. Further, while the electric duster 302 is also provided with a switch 326 for controlling the operation of the electric duster 302 and a battery compartment 316 for providing power to the drive mechanism, both the switch 326 and the drive mechanism are located at the grip portion. The switch 326 and the batteries 320 from the battery compartment 316 and the drive mechanism are electrically connected.

Figure 13:
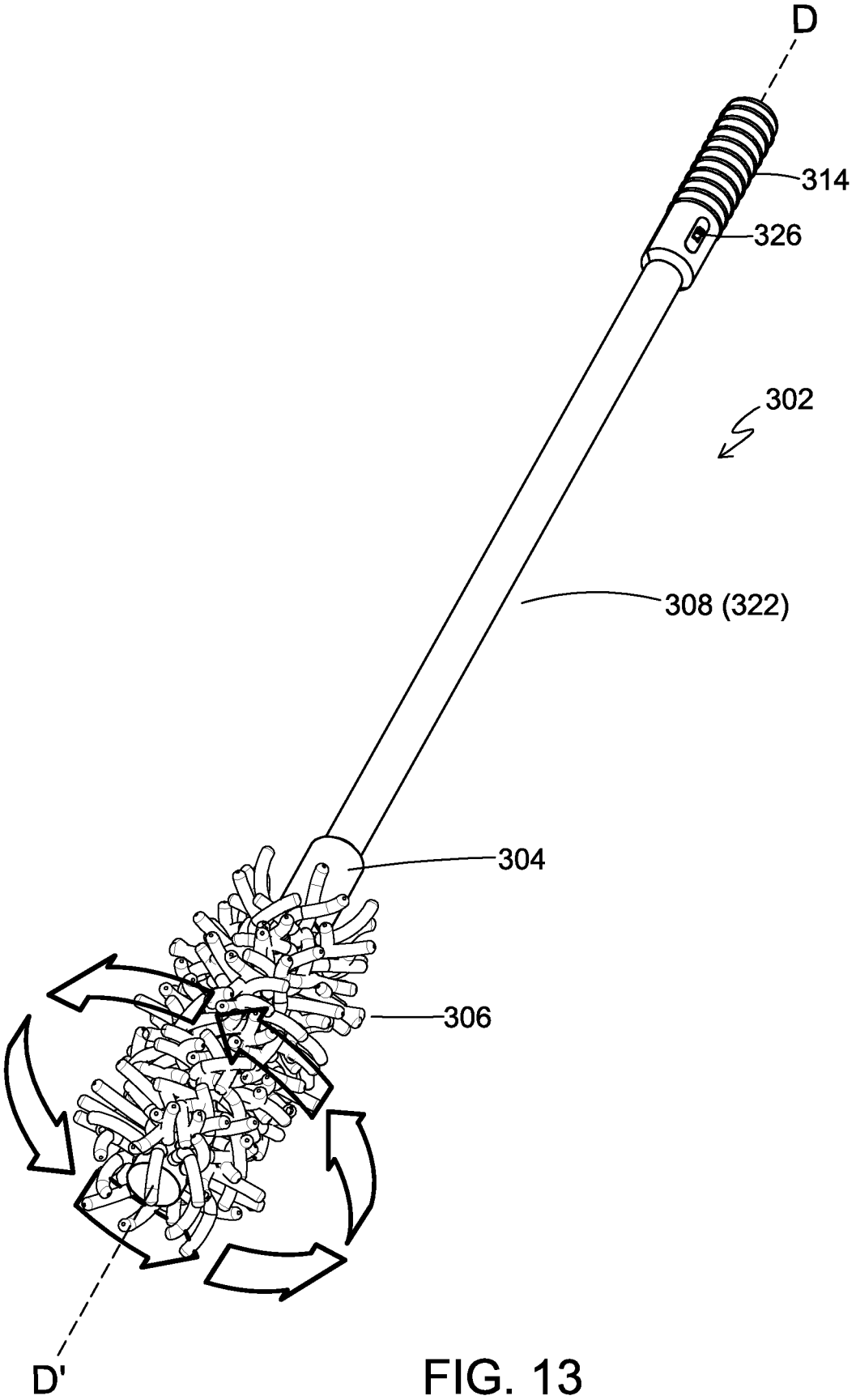
FIG. 13 is a schematic diagram illustrating a third embodiment of an electric duster according to the present invention.
Figures 14A, 14B:
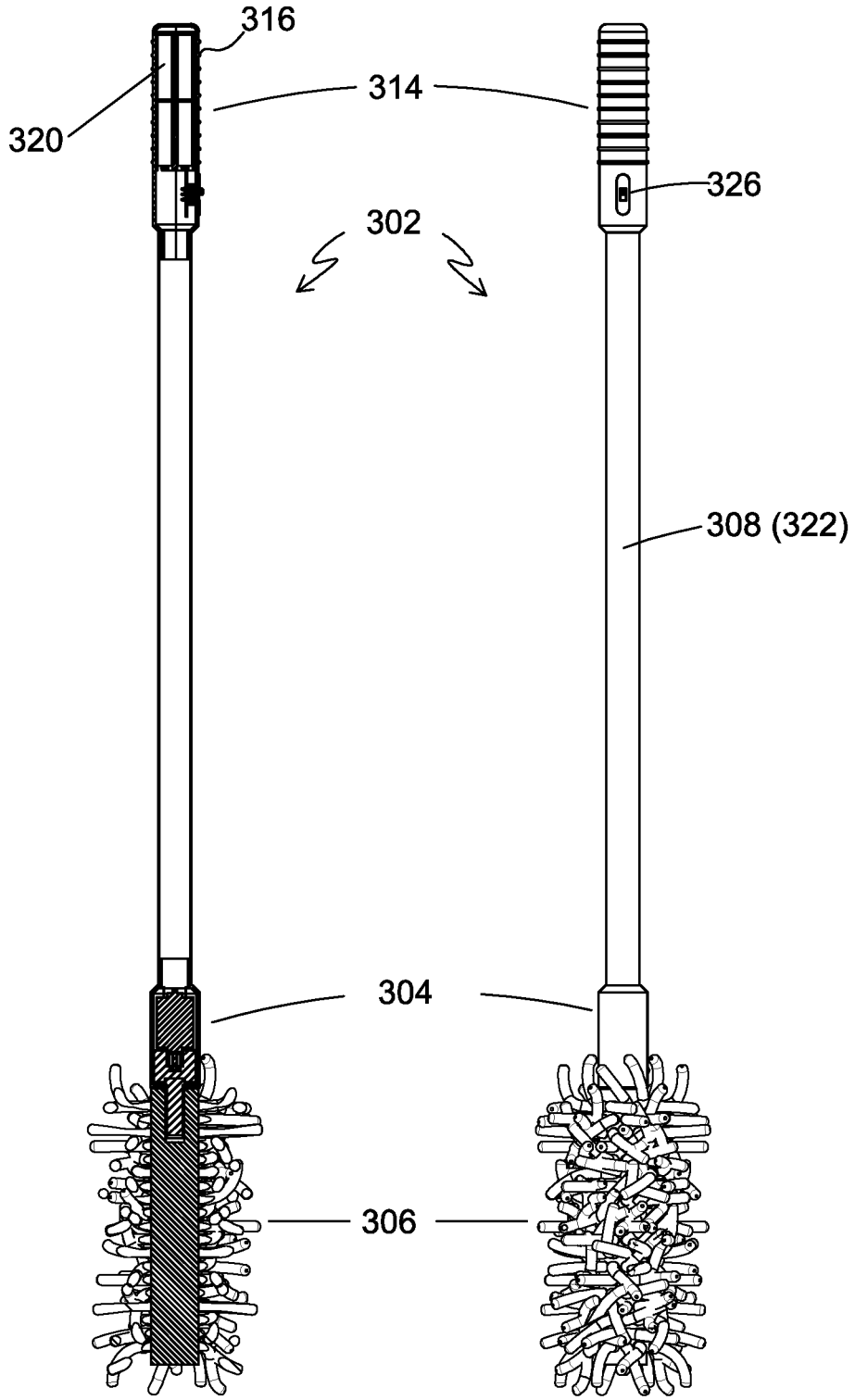
FIG. 14A is a side view of the electric duster of FIG. 13
FIG. 14B is a schematic view showing internal structures thereof.
Figures 15A, 15B, 15C:
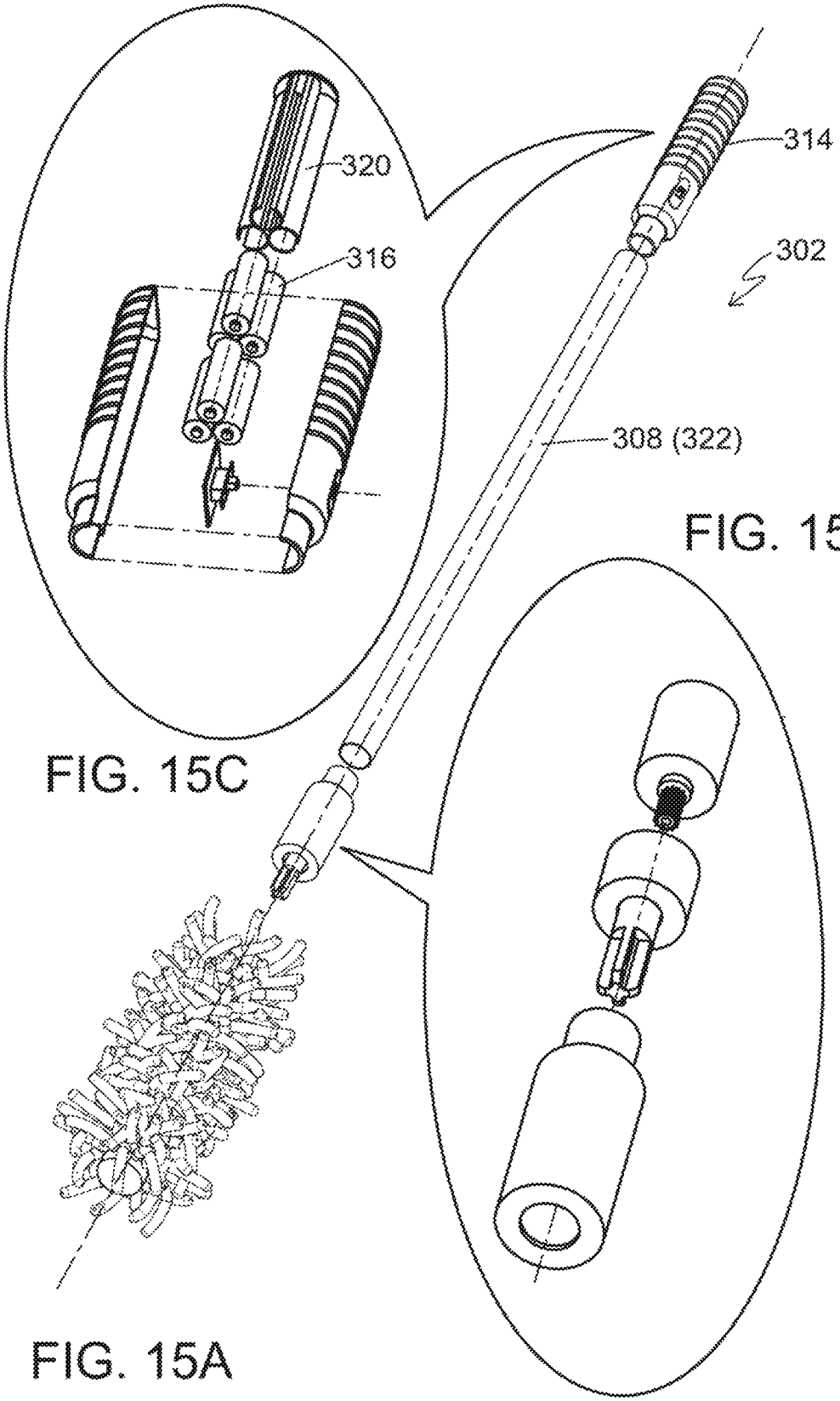
FIG. 15A is an exploded view of the electric duster of FIG. 13.
FIG. 15B is a schematic view showing a drive mechanism of the electric duster of FIG. 15A.
FIG. 15C is a schematic view showing a grip portion of the electric duster of FIG. 15A.

FIGS. 15A to 15C are exploded view of the electric duster of FIG. 13. Likewise, the switch 326 allows different rotational mode, e.g. off, clockwise rotation, anti-clockwise rotation, reciprocating rotation.

Figure 16:
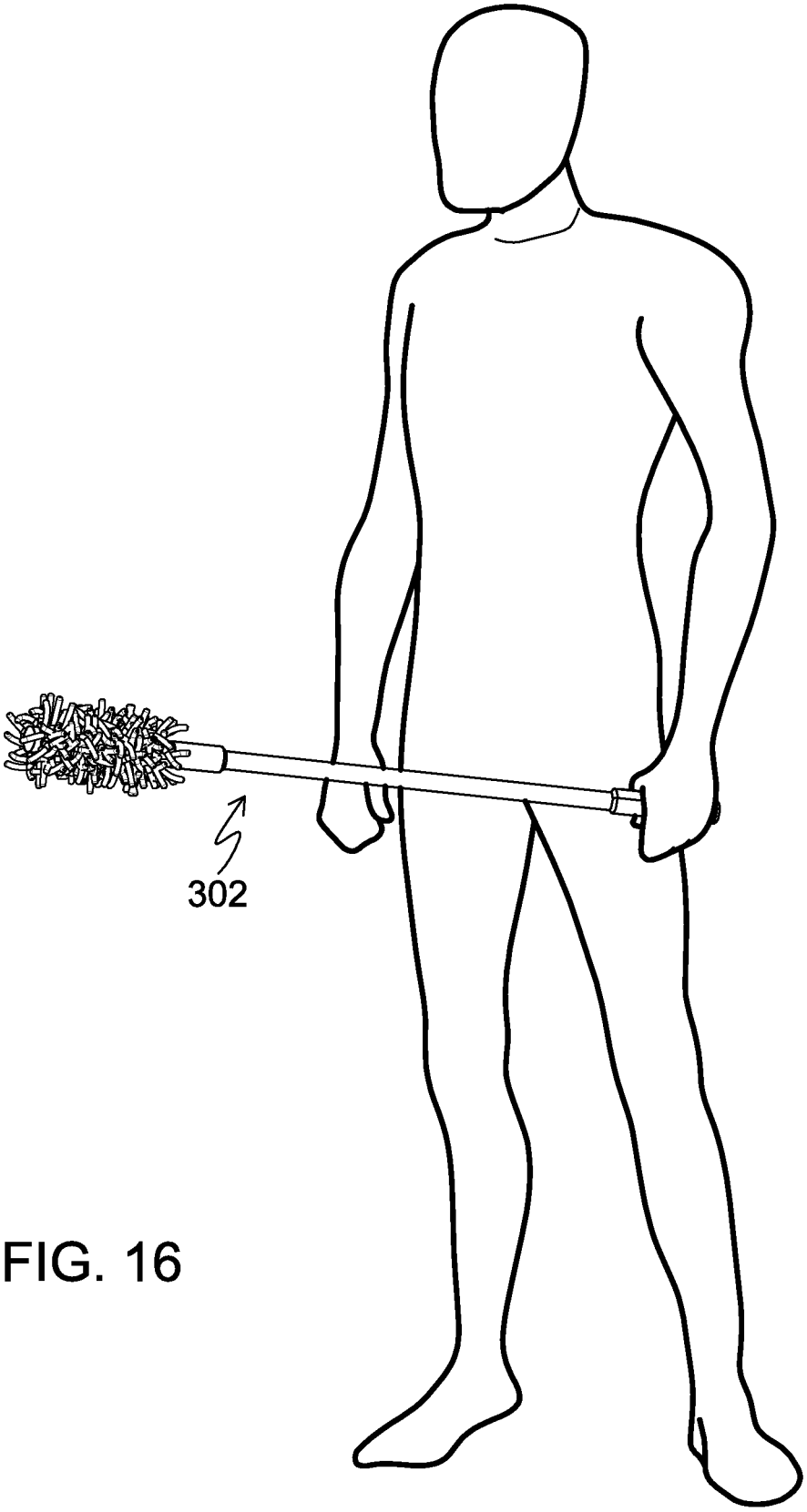
FIG. 16 is a schematic view showing a user holding on to the electric duster of FIG. 9.

FIG. 16 is a schematic view showing a user holding on to the electric duster of FIG. 9.

Positioning of the drive mechanism at the distal end of the electric duster 302 and the switch 302 and the battery compartment 312 at the proximal end of the electric duster 302 is beneficial in a multi-fold manner. One advantage is that weight distribution along the electric duster is more balanced. Second, the switch 326 located right at the grip portion 314 is easily reachable by a flick of a finger of the user.

The afore-described embodiments all share the feature of the core member to which the cleaning filament sock is fitted. In the embodiments, the core member assumes the configuration of a cylindrical block to which either the axle head or a connecting axle engages. However, the core member may alternatively be configured slightly differently in that the block is somewhat flattened such that a transverse cross section of the block is has an oval shape. One advantage of this flattened or oval shape is that the utility portion can reach even smaller gaps, e.g. between a refrigerator and an adjacent wall.

Regardless of the exact profile of the core member, the utility portion, preferably, has a width or diameter from 1 cm to 4 cm. In a more preferred embodiment, the width or diameter is from 1 cm to 2 cm. The length of the core member is preferably at least 12 cm, and up to 60 cm.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

What is claimed is:

1. An electric duster with an elongate profile defining a longitudinal axis, comprising a utility portion arranged at a distal end of the electric duster, a grip portion arranged at a proximal end of the electric duster and a connecting portion arranged between the utility portion and the grip portion, wherein:

the utility portion is rotatable about the longitudinal axis, the electric duster is further provided with a chamber containing a drive mechanism providing rotational drive to the utility portion, the drive mechanism includes a motor, a gear box and, an axle head extending from the gear box and directly driving the utility portion, the chamber is positioned behind the utility portion and arranged between the utility portion and the connecting portion and the electric duster is free of a connecting axle, for directly driving the utility portion, thereby allowing the actuation of the utility portion in a more responsive manner, a switch for controlling operation of the drive mechanism is mounted on the chamber, and the utility portion is rotatable, reciprocatingly, about the longitudinal axis.

2. An electric duster as claimed in claim 1, wherein the utility portion includes a core member and brushing filaments enveloping the core member whereby in use rotation of the core member causes corresponding rotation of the brushing filaments.

3. An electric duster as claimed in claim 2, wherein the utility portion has a width or diameter from 1-4 cm and the core member has a length of at least 12 cm.

4. An electric duster as claimed in claim 1, wherein the brushing filaments assume the form of a sock enveloping the core member and are removably securable to the core member.

5. An electric duster as claimed in claim 1, wherein the connecting portion includes one or more circular tubes telescopically extendible along the longitudinal axis.

6. An electric duster as claimed in claim 1, comprising a battery compartment positioned adjacent and behind the chamber, and within the distal end of the connecting portion.

7. An electric duster as claimed in claim 1, wherein the switch is protruded from the chamber.

8. An electric duster as claimed in claim 1, wherein the connecting portion includes at least a first circular tube, a second circular tube and the chamber.

9. An electric duster as claimed in claim 8, comprising a battery compartment positioned adjacent and behind the chamber, and within the distal end of the second circular tube.

10. An electric duster as claimed in claim 1, comprising a compartment for batteries housed in the grip portion providing power to the motor.

11. An electric duster as claimed in claim 1, comprising electric wires connecting and extending from the switch, batteries and the drive mechanism.

* * * * *